US008569661B2

(12) United States Patent
Kemper et al.

(10) Patent No.: US 8,569,661 B2
(45) Date of Patent: Oct. 29, 2013

(54) HOUSEHOLD APPLIANCE

(75) Inventors: Lars Kemper, Oelde (DE); Joachim Render, Warendorf (DE)

(73) Assignee: Miele & Cie. KG, Guetersloh (DE)

( * ) Notice: Subject to any disclaimer, the term of this patent is extended or adjusted under 35 U.S.C. 154(b) by 196 days.

(21) Appl. No.: 12/974,163

(22) Filed: Dec. 21, 2010

(65) Prior Publication Data

US 2011/0147361 A1 Jun. 23, 2011

(30) Foreign Application Priority Data

Dec. 23, 2009 (EP) ..... 09401052

(51) Int. Cl.
*A21B 1/00* (2006.01)
*F24C 15/32* (2006.01)

(52) U.S. Cl.
USPC ..... 219/394; 219/214; 219/392; 219/398; 219/391; 219/393; 219/395; 219/402; 219/403; 126/21 A; 126/273 R; 126/25 A

(58) Field of Classification Search
USPC ..... 219/214, 394, 391, 393, 395, 398, 392, 219/402, 403; 126/21 A, 273 R, 25 A
See application file for complete search history.

(56) References Cited

U.S. PATENT DOCUMENTS

| | | | | |
|---|---|---|---|---|
| 4,535,610 | A | 8/1985 | Fey | |
| 2006/0219234 | A1 | 10/2006 | Larsen | |
| 2007/0108179 | A1 | 5/2007 | Hines, Jr. | |
| 2007/0175885 | A1 * | 8/2007 | Brower et al. | 219/401 |
| 2008/0308709 | A1 | 12/2008 | Tartan | |

FOREIGN PATENT DOCUMENTS

| | | | |
|---|---|---|---|
| EP | 1616991 | * | 1/2006 |
| EP | 1616991 | A1 | 1/2006 |
| GB | 2026685 | A | 2/1980 |
| WO | WO 2006123303 | A2 | 11/2006 |

* cited by examiner

*Primary Examiner* — Shawntina Fuqua
(74) *Attorney, Agent, or Firm* — Leydig, Voit & Mayer, Ltd.

(57) ABSTRACT

A household appliance includes a first oven, a second oven disposed above the first oven and a shared housing surrounding the first and second ovens. The shared housing includes two separable parts defining a partition plane between the first and second ovens. At least one connecting element forms a hinged connection between the two separable parts of the shared housing. Control, operating and display elements are disposed in a top part of the shared housing.

10 Claims, 4 Drawing Sheets

HOUSEHOLD APPLIANCE

CROSS REFERENCE TO RELATED APPLICATIONS

This application claims priority to European Patent Application No. EP 09 401 052.7, filed Dec. 23, 2009, which is hereby incorporated by reference herein in its entirety.

FIELD

The invention relates to a household appliance, especially to a dual oven.

BACKGROUND

Built-in kitchens are increasingly being equipped with two ovens arranged one above the other in the form of a so-called dual oven in a shared housing in a kitchen cabinet, so that different baking and cooking processes can be carried out, especially at the same time. As a rule, such a dual oven has shared control, operating and display elements for both ovens in the top part of the housing. Usually, each oven has its own separate cooling-air system above the associated oven chamber so that sufficient cooling can be achieved. In order to be able to ensure the proper operation of both ovens, the electric systems, especially those located separately in the lower oven, are connected by means of electric connection lines to the central control and operating unit located in the top part of the housing. The drawback of such an oven construction is that, especially in the case of repair or maintenance work on the system or on components in the part of the housing above the lower oven, the built-in dual oven should be completely taken out of the kitchen cabinet and the shared housing has to be removed so that the upper oven can be lifted down from the lower oven in order for repair and maintenance work to be performed. Moreover, the connection lines between the two ovens arranged one above the other have to be disconnected for this purpose. It is also disadvantageous that, due to the size of such dual ovens, such repair and maintenance work normally has to be carried out by at least two people, resulting in higher labor costs, even for simple repair and maintenance work.

SUMMARY

In an embodiment, the present invention provides a household appliance including a first oven, a second oven disposed above the first oven and a shared housing surrounding the first and second ovens. The shared housing includes two separable parts defining a partition plane between the first and second ovens. At least one connecting element forms a hinged connection between the two separable parts of the shared housing. Control, operating and display elements are disposed in a top part of the shared housing.

BRIEF DESCRIPTION OF THE DRAWINGS

Exemplary embodiments of the present invention are described in more detail presented below, with reference to the drawings, in which.

DETAILED DESCRIPTION

Figure 1:
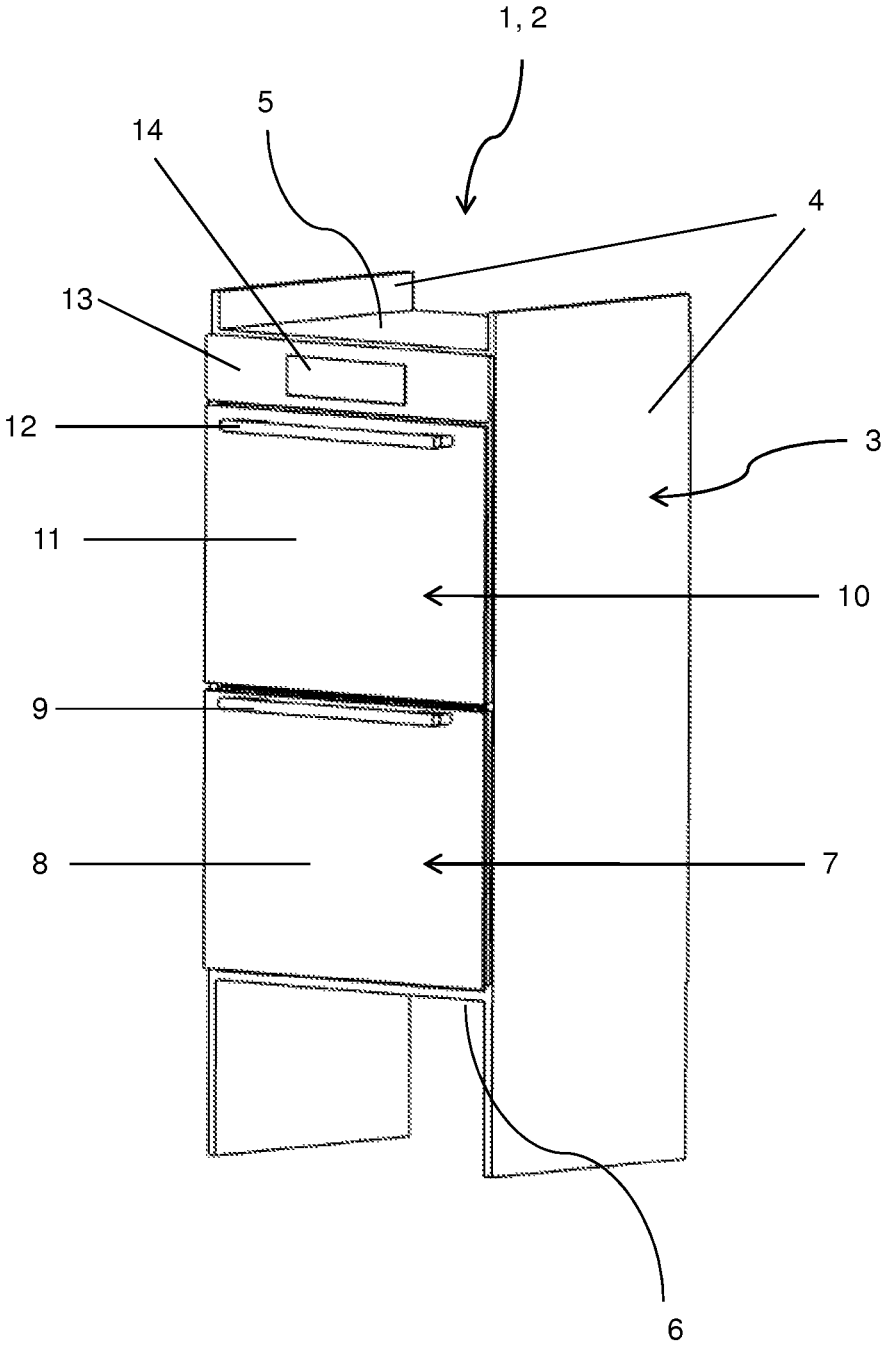
FIG. 1 shows a schematic side view of the household appliance in the form of a dual oven in a built-in cabinet.

In an embodiment, the present invention provides a dual oven in such a manner that repair and maintenance work in the top part of the housing of the lower oven can be carried out with less effort.

Since the shared housing of a household appliance, especially a dual oven with two ovens arranged one above the other, comprises a partition plane situated between the upper and lower ovens, and since the two separable parts of the housing have at least one connecting element for a hinged connection, it is ensured that repair or maintenance work on components located above the chamber of the lower oven, particularly on the cooling-air system and on the door closure, can also be performed by one person. In order for maintenance or repair work to be performed, the built-in dual oven is pulled out of the built-in cabinet and placed onto a frame or support cart positioned in front of the built-in cabinet, and the upper oven can then be simply tilted towards the back by means of the hinged connection, so as to allow free access to the top part of the housing of the lower oven. There is no longer a need for a second person in order to be able to take the upper oven down from the lower oven. Moreover, the electric or electronic connection lines between the two individual ovens remain in place.

In an embodiment of the invention, the partition plane is advantageously situated in the area of the bottom of the upper oven and of the top of the lower oven, whereby at least two connecting elements that create a hinged connection between the upper and lower ovens are present on the back wall of the housing of the upper and lower ovens, so that, when the dual oven has been pulled out of the cabinet, the upper oven can be easily pivoted towards the back around a horizontal pivoting axis so that maintenance and repair work requiring less time and personnel can be performed in the part of the housing above the chamber of the lower oven.

In an embodiment of the invention, the back wall of the upper oven and the back wall of the lower oven each consist of a one-piece sheet metal part, and the back walls are connected to each other so as to be hinged in the partition plane by means of a tab connection, so that a hinged connection between the upper and lower ovens of a dual oven can be achieved with a simple construction and without the use of costly connecting elements. In the simplest case, two tabs located in the top part of the sheet metal part that forms the lower back wall extend towards the sheet metal part that forms the upper back wall, and these tabs are attached to the upper back wall with fastening means, preferably a screwed connection.

In an embodiment, the width of the tabs decreases towards the ends, and the back wall of the upper oven has a recess that matches each tab and has a stop element located behind it, so that the connecting element serves to create not only a hinged connection but also a centering means to precisely center the upper oven on the lower oven. The stop element arranged behind the recess serves to fasten the tab to the back wall of the upper oven, preferably by means of a screwed connection.

In order to limit the pivoting of the upper oven around the horizontal pivoting axis with respect to the lower oven in the area of the partition plane, in an embodiment, the hinged connection can be limited by means of a stop element. It is conceivable for this limitation to be achieved by means of at least one detachably affixed chain element in the area of the partition plane, preferably in the front area of the side walls of the upper and lower ovens.

In another embodiment of the invention, the hinged connection between the upper and the lower ovens in the area of the partition plane is formed by a hinge that can be mounted on both of the back walls.

FIG. 1 shows a schematic side view of a household appliance 2 configured as a dual oven 1, in a built-in cabinet 3. The built-in cabinet 3 consists of side walls 4, a top cover panel 5 and a bottom panel 6, and it forms the installation space for the dual oven 1. A lower oven 7 on whose front there is an appliance door 8 with a door handle 9 is placed in this installation space on the bottom panel 6. The appliance door 8 closes off an oven chamber. In order to achieve sufficient cooling of the lower oven 7, cooling-air elements are arranged above the oven chamber. An upper oven 10 is placed in the installation space directly above the lower oven 7. This upper oven 10, like the lower oven 7, has an appliance door 11 with a door handle 12. The upper appliance door 11 likewise closes off an oven chamber. Above the upper appliance door 11, there is additionally an operating panel 13 with a display and operating unit. The display and operating unit 14 serves to centrally set and display operating parameters of the upper and lower ovens 7, 10. Electric or electronic control and regulation devices that serve to control and regulate both ovens 7, 10 as well as cooling-air elements to cool the upper oven 10 are located centrally above the oven chamber behind the operating panel 13 of the upper oven 10. The dual oven 1 is normally installed in a built-in cabinet 3 once the upper oven 10 has been placed onto the lower oven 7, and once the requisite, generally known electric or electronic connection lines between the two ovens 7, 10 have been connected. At least two people are normally needed for this purpose, especially when the dual oven 1 has to be lifted up from the floor and installed in a raised built-in cabinet 3, as depicted here.

Figure 2:
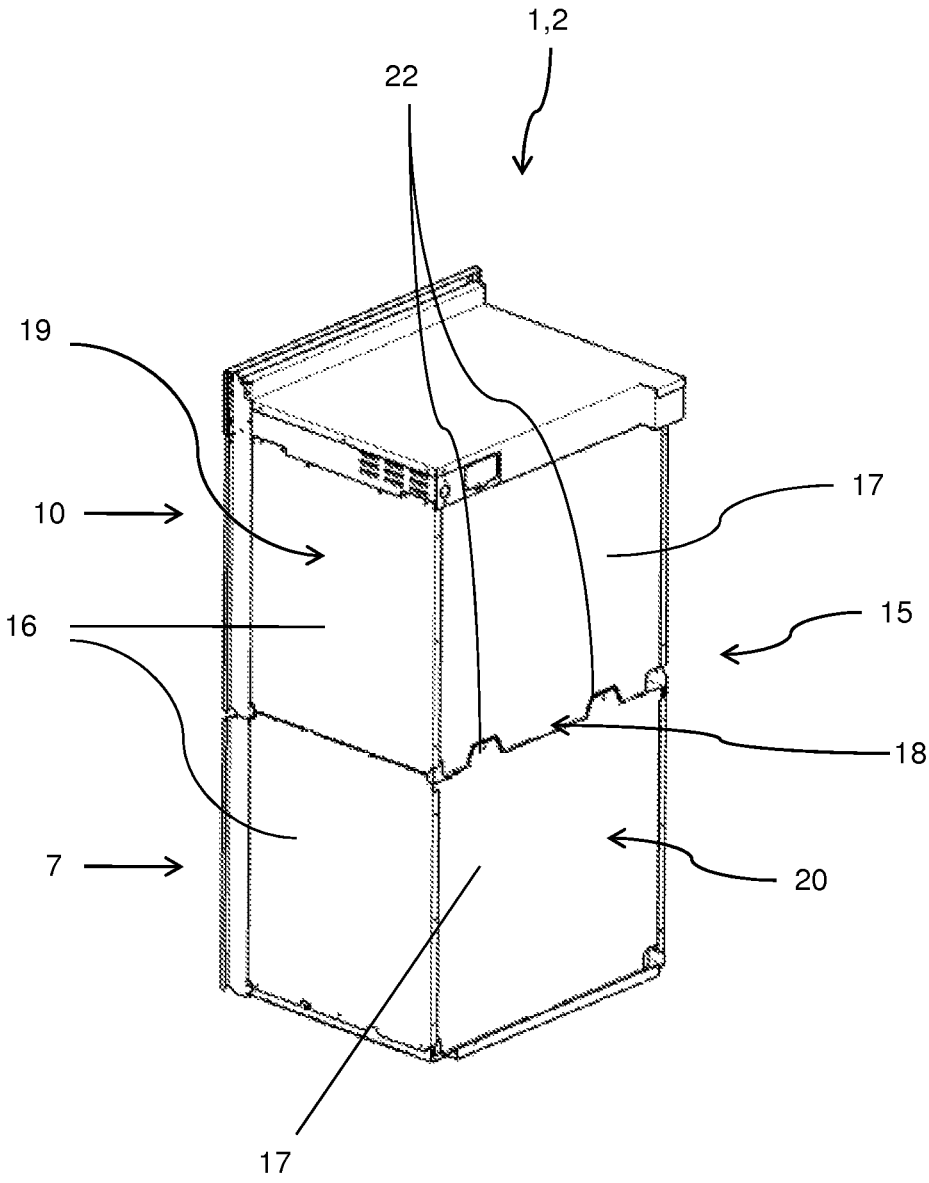
FIG. 2 shows a schematic depiction of the dual oven shown in FIG. 1, in a rear view without a built-in cabinet.

FIG. 2 shows the construction of the dual oven 1 depicted in FIG. 1, in a schematic rear view without a built-in cabinet. The dual oven 1 consists of a lower oven 7 and an upper oven 10. In the built-in state, the lower oven 7 and the upper oven 10 are surrounded by a housing 15. The housing 15 consists of side walls 16 and back walls 17 which, in the installed state, are detachably joined together at a partition plane 18 and which can be made of sheet metal parts. The connection of the top part of the housing 19 to the bottom part 20 of the housing can be implemented in a familiar manner by means of a screwed connection. Other connection modalities known to the person skilled in the art fall within the scope of the invention. In order for maintenance or repair work to be carried out, especially on components located in the area above the chamber of the lower oven 7, the top and bottom parts 19, 20 of the housing are joined to each other according to the invention by means of at least one connecting element 22 implemented as a hinged connection. Here, this hinged connection is created by means of two tabs 23 arranged in the top part of the back wall 17 of the lower oven 7, said tabs 23 extending towards the back wall 17 of the upper oven 10. The back wall 17 of the lower oven 7 is preferably connected to the back wall 17 of the upper oven 10 by means of a screwed connection. In order for maintenance or repair work to be carried out, the dual oven 1 should be completely pulled out of the built-in cabinet.

Figure 3:
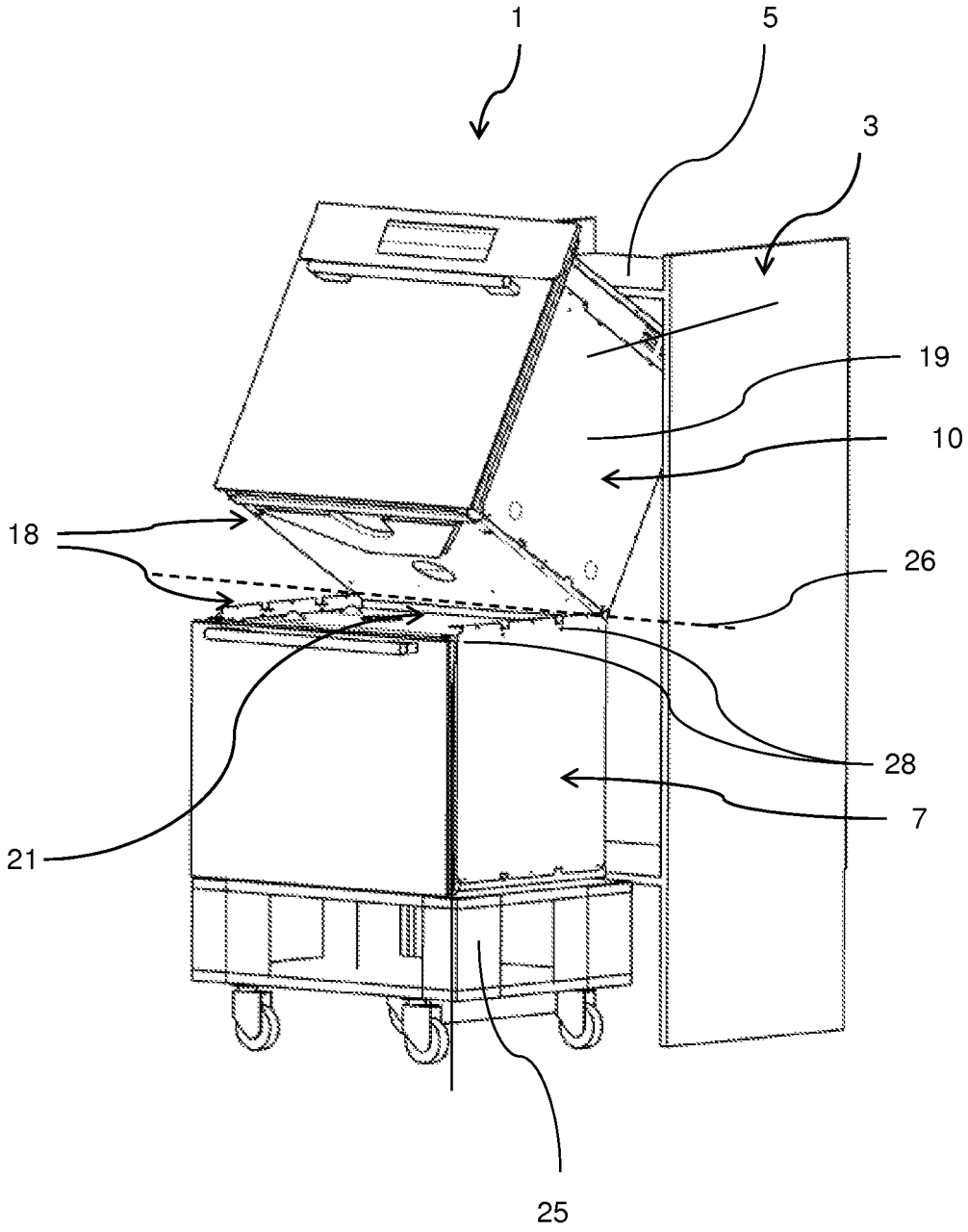
FIG. 3 shows a schematic depiction of the dual oven of FIGS. 1 and 2 pulled out of the built-in cabinet, with the upper oven pivoted back.

FIG. 3 then shows the dual oven 1 after it has been pulled out of the built-in cabinet. In order not to have to place the dual oven 1 on the floor once it has been pulled out, the dual oven 1 is placed onto a support cart 25 whose height corresponds to the lower installation height of the dual oven 1 in the built-in cabinet 3. The detachable connections 28 that have affixed the two parts 19, 20 of the housing of the upper and lower ovens 7, 10 in the installed state are detached from each other in the area of the partition plane 18. The upper oven 10 is in a position in which it is pivoted towards the back around a horizontal pivoting axis located in the area of the partition plane 18, so that the area 21 above the chamber of the lower oven 7 can be accessed in order for maintenance or repair work to be performed. The hinged connection is created by means of the connecting elements shown in greater detail in FIG. 4. In the simplest case, the cover panel 5 of the built-in cabinet 3 serves as a stop element for the upper oven 10 so as to prevent the upper oven 10 from pivoting too far around the horizontal pivoting axis 26. It falls within the scope of the invention that at least one stop element is arranged on the housing of the dual oven 1, preferably in the area of the partition plane 18, in order to limit the pivoting of the upper oven 10 around the pivoting axis 26, thus preventing the upper oven 10 from tipping over completely due to the force of gravity.

Therefore, the upper oven 10 does not have to be lifted down from the lower oven 7 so that maintenance or repair work can be carried out in the area 21 above the chamber of the lower oven 7. Consequently, the work can be performed by one person.

Figure 4:
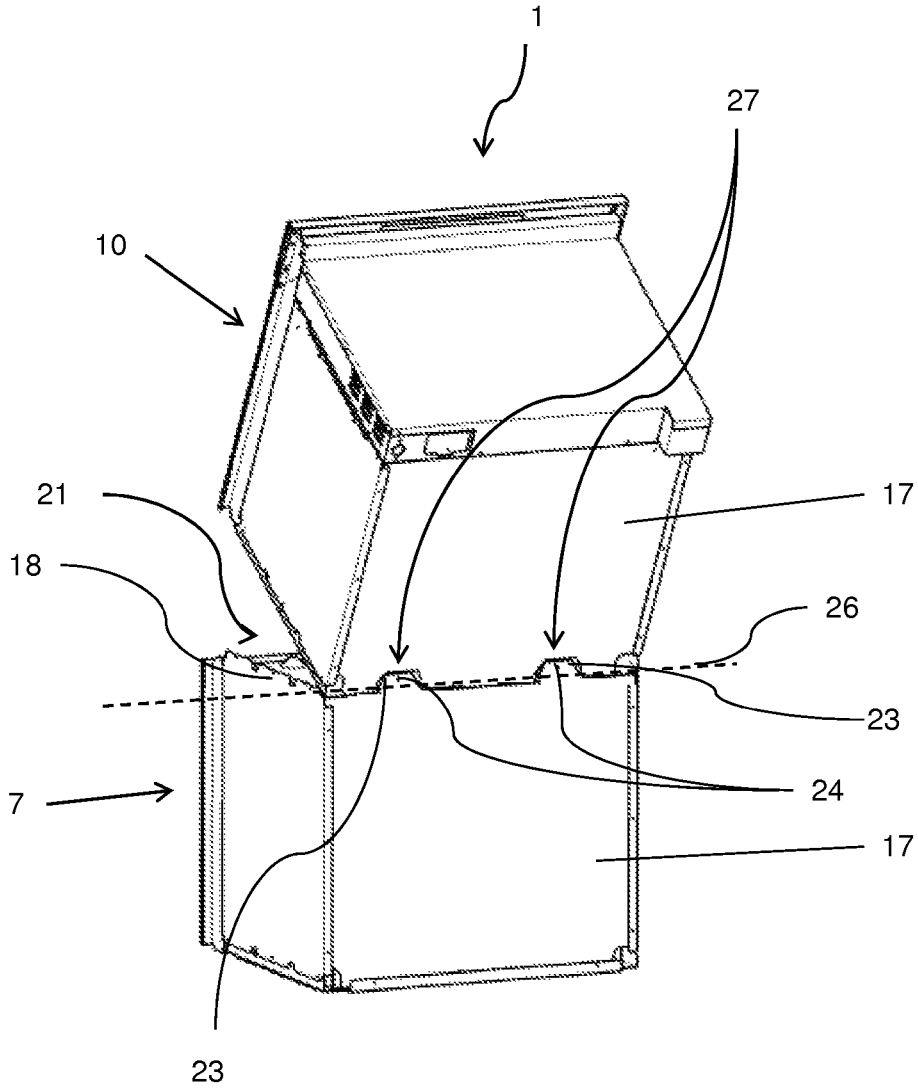
FIG. 4 shows the dual oven of FIG. 3, in a rear view without a built-in cabinet.

FIG. 4 shows a schematic side view of the dual oven 1 depicted in FIG. 3. The upper oven 10 is in a position in which it has been pivoted towards the back around the horizontal pivoting axis 26. In the upper area 21 of the one-piece sheet metal back wall 17 of the lower oven 7, there are two tabs 23 extending towards a one-piece sheet metal back wall 17 of the upper oven 10, said tabs tapering towards their upper ends 27 and being detachably joined to the back wall 17 of the upper oven 10 by means of a screwed connection 24. Therefore, the hinged connection of the upper oven 10 to the lower oven 7 in the area of the partition plane 18 is created by means of the tabs 23 that are present.

Other embodiments of the invention can be made with other household appliances such as steam cookers, microwave ovens, refrigerators, coffee machines, dishwashers and washing machines, in order to achieve the above-mentioned effects,.

While the invention has been particularly shown and described with reference to preferred embodiments thereof, it will be understood by those skilled in the art that various changes in form and details may be made therein without departing from the spirit and scope of the invention.

LIST OF REFERENCE NUMERALS

1 dual oven
2 household appliance
3 built-in cabinet
4 side walls
5 cover panel
6 floor panel
7 lower oven
8 appliance door
9 door handle
10 upper oven
11 appliance door
12 door handle
13 operating panel
14 display and operating unit
15 housing
16 side wall
17 back wall

18 partition plane
19 top part of the housing
20 bottom part of the housing
21 area
22 connecting element
23 tab
24 screwed connection
25 support cart
26 pivoting axis
27 upper end
28 detachable connection

What is claimed is:

1. A household appliance comprising:

a first oven;

a second oven disposed above the first oven;

a shared housing surrounding the first and second ovens, the shared housing including two separable parts defining a partition plane between the first and second ovens, and at least one connecting element forming a hinged connection between the two separable parts of the shared housing; and control, operating and display elements disposed in a top pan of the shared housing.

2. The household appliance as recited in claim 1, wherein the appliance is a dual oven.

3. The household appliance as recited in claim 1, wherein the partition plane is defined in an area of a bottom of the second oven and a top of the first oven, wherein the shared housing includes a back wall, and wherein the at least one connecting element includes at least two connecting elements disposed on the back wall and forming the hinged connection.

4. The household appliance as recited in claim 1, wherein the first oven includes a first back wall formed by a one-piece sheet metal part and the second oven includes a second back wall formed by a one-piece sheet metal part, and wherein the at least one connecting element includes tabs in an area of the partition plane.

5. The household appliance as recited in claim 1, wherein the first oven includes a first back wall formed by a one-piece sheet metal part and the second oven includes a second back wail formed by a one-piece sheet metal part, and wherein the at least one connecting element includes first and second tabs extending from a top part of the one-piece sheet metal part forming the first back wall, the two tabs extending toward the one-piece sheet metal part forming the second back wall, each tab being attached to the second back wall by a fastener.

6. The household appliance as recited in claim 5, wherein the fastener includes a screwed connection.

7. The household appliance as recited in claim 4 wherein each tab includes an end and a width of each tab decreases toward the respective end, and wherein the second back wall includes a respective recess corresponding to each tab and a stop element disposed behind each recess.

8. The household appliance as recited in claim 5 wherein each tab includes an end and a width of each tab decreases toward the respective end, and wherein the one-piece sheet metal part forming the second back wall includes a respective recess corresponding to each tab, and further comprising a stop element disposed behind each recess.

9. The household appliance as recited in claim 1, wherein the at least one connecting element includes a hinge mounted to a back wall of the first oven and a back wall of the second oven in an area of the partition plane.

10. The household appliance as recited in claim 1, further comprising a stop element configured to limit a range of movement of the hinged connection.

* * * * *